US007328860B1

(12) United States Patent
Chen

(10) Patent No.: US 7,328,860 B1
(45) Date of Patent: Feb. 12, 2008

(54) WATER SPRAYER HAVING FLOW REGULATING FUNCTION

(75) Inventor: Chin-Yuan Chen, Lu Kang Chen (TW)

(73) Assignee: Shin Tai Spurt Water of the Garden Tools Co., Ltd., Changhua Hsien (TW)

( * ) Notice: Subject to any disclaimer, the term of this patent is extended or adjusted under 35 U.S.C. 154(b) by 0 days.

(21) Appl. No.: 11/523,839

(22) Filed: Sep. 20, 2006

(51) Int. Cl.
*B05B 1/30* (2006.01)

(52) U.S. Cl. ..... 239/581.1; 239/526; 239/583; 239/443; 239/394; 137/625.31

(58) Field of Classification Search ..... 239/526, 239/525, 527, 528, 529, 581.1, 582.1, 569, 239/443, 378; 137/625.31, 625.32
See application file for complete search history.

(56) References Cited

U.S. PATENT DOCUMENTS 1,704,498 A * 3/1929 Deming ..... 239/416.2
2,144,619 A * 1/1939 Corley ..... 239/581.1
3,412,941 A * 11/1968 Steinback ..... 239/581.1
4,358,058 A * 11/1982 Bierman ..... 239/447
4,903,897 A * 2/1990 Hayes ..... 239/394
4,997,131 A * 3/1991 Heren ..... 239/397.5
5,303,868 A * 4/1994 Kroll ..... 239/394

* cited by examiner

*Primary Examiner*—Dinh Q. Nguyen
(74) *Attorney, Agent, or Firm*—Alan Kamrath; Kamrath & Associates PA

(57) ABSTRACT

A water sprayer includes a handle having an inside formed with a water inlet channel and an end portion formed with a mounting seat which has a water conduit and a receiving chamber, a control shaft rotatably mounted in the receiving chamber of the handle and having a first side formed with a stop wall and a second side formed with a connecting slot, and a control handle pivotally mounted on the mounting seat and connected to the control shaft to control rotation of the control shaft. Thus, the control shaft is rotatable to regulate the water flow rate injected from the spraying head, so that the water sprayer has a flow regulating function.

17 Claims, 9 Drawing Sheets

WATER SPRAYER HAVING FLOW REGULATING FUNCTION

BACKGROUND OF THE INVENTION

1. Field of the Invention

The present invention relates to a sprayer and, more particularly, to a water sprayer for spraying water outwardly.

2. Description of the Related Art

A water sprayer is connected to a water pipe which is connected to a faucet. Thus, the water from the faucet flows through the water pipe into the water sprayer and is injected outwardly from the nozzle of the water sprayer. The conventional water sprayer comprises a control lever to control the water flow rate injected outwardly from the nozzle by pressing the control lever. In operation, when the user applies a larger force to press the control lever, the control valve contained in the water sprayer is opened to a larger extent to increase the water flow rate, and when the user applies a smaller force to press the control lever, the control valve contained in the water sprayer is opened to a smaller extent to decrease the water flow rate. Thus, the water flow rate injected outwardly from the nozzle is controlled by pressing the control lever. However, the user has to hold and press the control lever constantly to control the water flow rate of the water sprayer, thereby causing inconvenience to the user.

BRIEF SUMMARY OF THE INVENTION

In accordance with the present invention, there is provided a water sprayer, comprising a handle having an inside formed with a water inlet channel and an end portion formed with a mounting seat which has a first end formed with a water conduit and a mediate portion formed with a receiving chamber connected to the water inlet channel and the water conduit, a control shaft rotatably mounted in the receiving chamber of the mounting seat of the handle and having a first side formed with a stop wall and a second side formed with a connecting slot, and a control handle pivotally mounted on the mounting seat of the handle and connected to the control shaft to control rotation of the control shaft.

The primary objective of the present invention is to provide a water sprayer having a flow regulating function.

Another objective of the present invention is to provide a water sprayer having a micro-adjustment control function to control the flow rate.

A further objective of the present invention is to provide a water sprayer, wherein the control shaft is rotatable to regulate the water flow rate injected from the spraying head, so that the water sprayer has a flow regulating function.

A further objective of the present invention is to provide a water sprayer, wherein the control handle is positioned by the positioning member so that the control shaft is driven by the control handle to rotate step by step so as to regulate the water flow rate in a micro-adjustment manner.

A further objective of the present invention is to provide a water sprayer, wherein the control handle is positioned by the positioning member to position the control shaft, so that the water sprayer has a constant water flow rate after adjustment of the control shaft.

A further objective of the present invention is to provide a water sprayer, wherein the control handle is positioned by the positioning member so that the control shaft is positioned after adjustment of the water flow rate, and the user needs not to hold the control handle to keep the water flow rate at a constant value, thereby facilitating the user operating the water sprayer.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
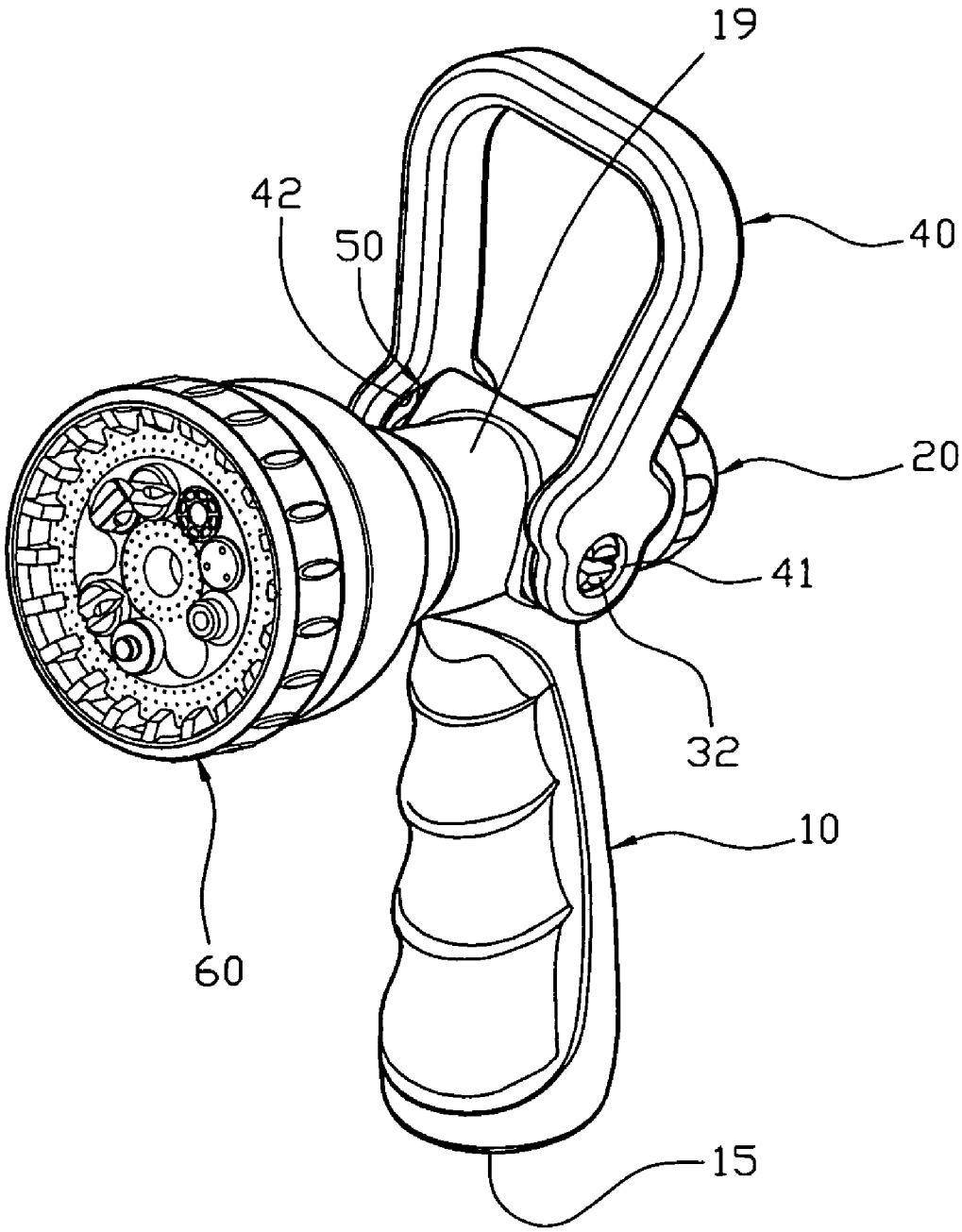
FIG. 1 is a perspective view of a water sprayer in accordance with the preferred embodiment of the present invention.
Figure 2:
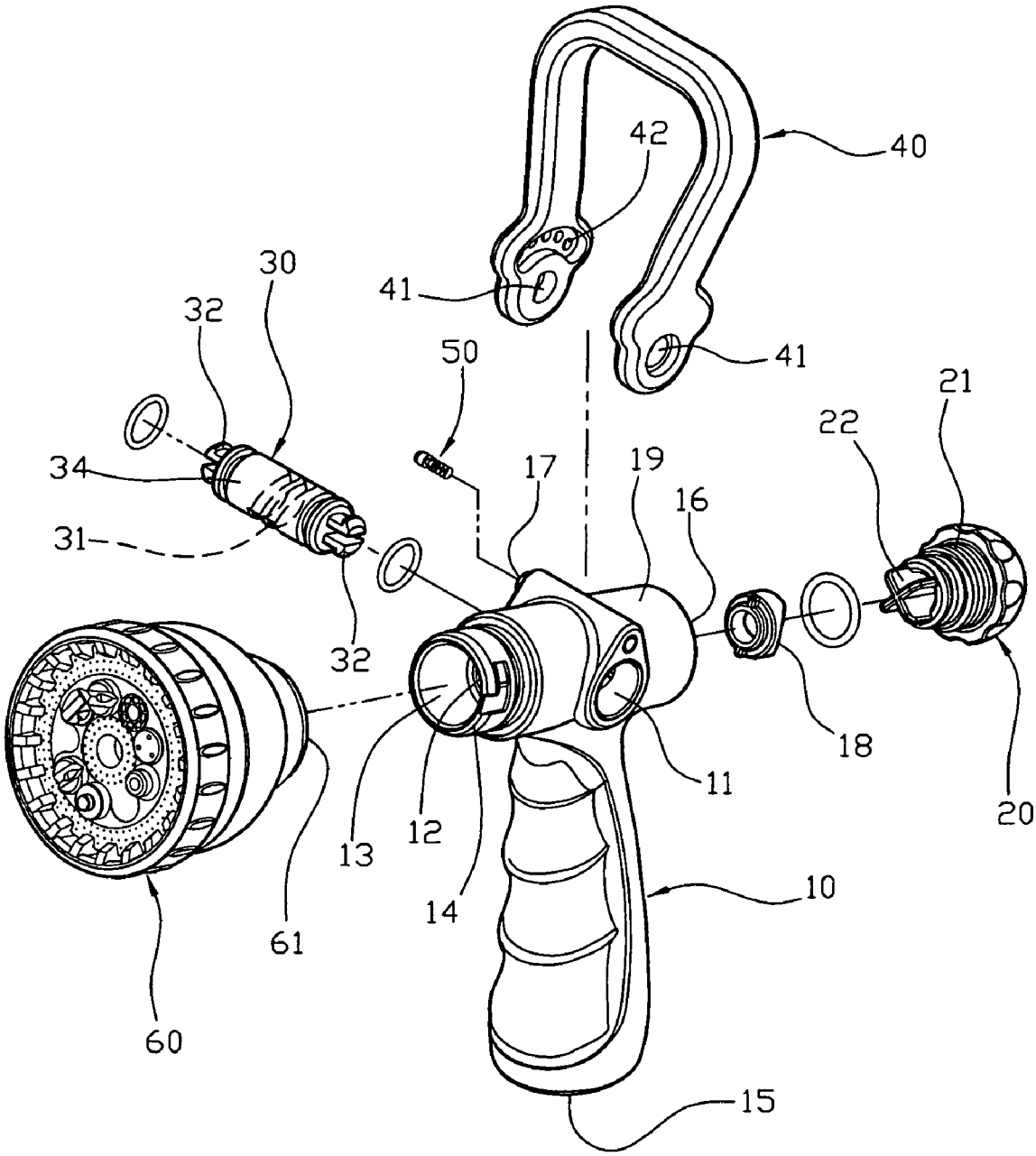
FIG. 2 is an exploded perspective view of the water sprayer as shown in FIG. 1.

Referring to the drawings and initially to FIGS. 1-4, a water sprayer in accordance with the preferred embodiment of the present invention comprises a handle 10 having an inside formed with a water inlet channel 15 connected to a water source (not shown) and an end portion formed with a mounting seat 19 which has a first end formed with a water conduit 12, a mediate portion formed with a receiving chamber 11 connected to the water inlet channel 15 and the water conduit 12 and a second end formed with an opening 16 connected to the receiving chamber 11, a control shaft 30 rotatably mounted in the receiving chamber 11 of the mounting seat 19 of the handle 10 and having a first side formed with a stop wall 34 and a second side formed with a connecting slot 31, a control handle 40 pivotally mounted on the mounting seat 19 of the handle 10 and connected to the control shaft 30 to control rotation of the control shaft 30, a spraying head 60 mounted on the mounting seat 19 of the handle 10 and connected to the water conduit 12 of the mounting seat 19 of the handle 10, an end cap 20 mounted on the opening 16 of the mounting seat 19 of the handle 10 and rested on the control shaft 30, and a gasket 18 mounted in the mounting seat 19 of the handle 10 and pressed between the control shaft 30 and an inner wall of the mounting seat 19 of the handle 10 and located between the receiving chamber 11 and the water conduit 12 of the mounting seat 19 of the handle 10.

Thus, the control shaft 30 is driven by the control handle 40 and is rotatable between a first position where the connecting slot 31 of the control shaft 30 aligns with the water inlet channel 15 of the handle 10 and the water conduit 12 of the mounting seat 19 of the handle 10 to open a connection between the water inlet channel 15 and the water conduit 12, and a second position where the stop wall 34 of the control shaft 30 aligns with and isolates the water conduit 12 of the mounting seat 19 of the handle 10 to interrupt the connection between the water inlet channel 15 and the water conduit 12.

The control shaft 30 has a cylindrical shape and has two ends each provided with a flexible locking portion 32 protruding from the receiving chamber 11 of the mounting seat 19 of the handle 10. The connecting slot 31 of the control shaft 30 is located at a middle portion of the control shaft 30.

The control handle 40 is substantially inverted U-shaped and has two opposite sides each formed with a locking hole 41 snapped and locked onto the respective locking portion 32 of the control shaft 30 to attach the control handle 40 onto the control shaft 30. The control handle 40 has a plurality of positioning holes 42 formed in at least one of the two opposite sides thereof and located above the locking hole 41. The positioning holes 42 of the control handle 40 surround the locking hole 41 and are arranged in an arc-shaped manner.

The receiving chamber 11 of the mounting seat 19 of the handle 10 traverses an axial direction of the mounting seat 19 of the handle 10. The first end of the mounting seat 19 of the handle 10 has a water outlet chamber 13 connected between the water conduit 12 and the spraying head 60. The first end of the mounting seat 19 of the handle 10 has an end face formed with a connector 14. The mediate portion of the mounting seat 19 of the handle 10 has a peripheral wall formed with at least one receiving recess 17 located above the receiving chamber 11 to receive a spring-biased positioning member 50 which is detachably positioned in one of the positioning holes 42 of the control handle 40 to temporarily position the control handle 40 on the mounting seat 19 of the handle 10.

The spraying head 60 has a distal end formed with a connecting portion 61 connected with the connector 14 of the mounting seat 19 of the handle 10.

The end cap 20 has a distal end formed with a protruding push portion 22 rested on the control shaft 30 to push the control shaft 30 toward the water conduit 12 of the mounting seat 19 of the handle 10 so that the water conduit 12 of the mounting seat 19 of the handle 10 is sealed closely by the stop wall 34 of the control shaft 30. The end cap 20 has a peripheral wall formed with a locking portion 21 inserted into and locked in the opening 16 of the mounting seat 19 of the handle 10.

Figure 3:
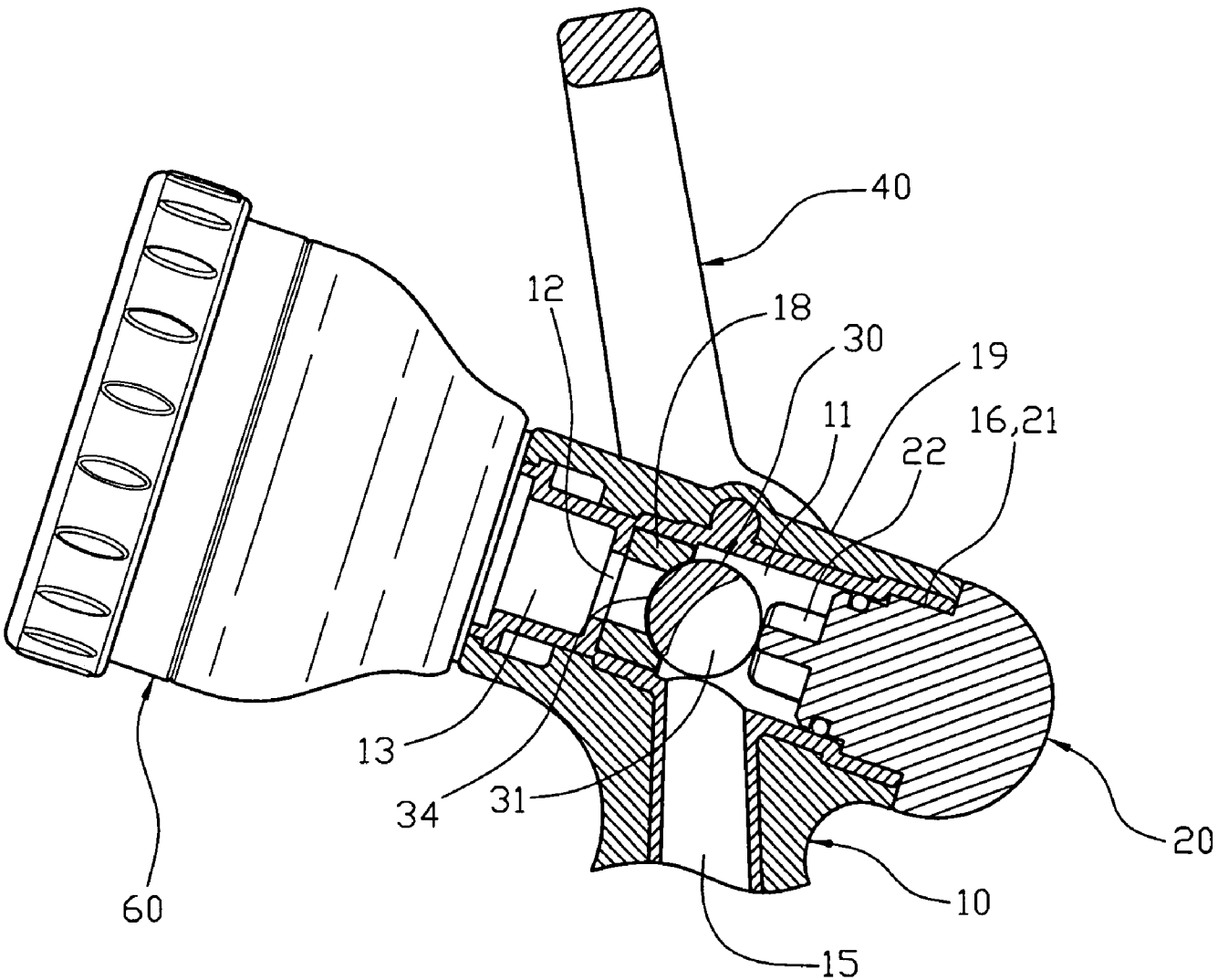
FIG. 3 is a partially plan cross-sectional view of the water sprayer as shown in FIG. 1.
Figure 4:
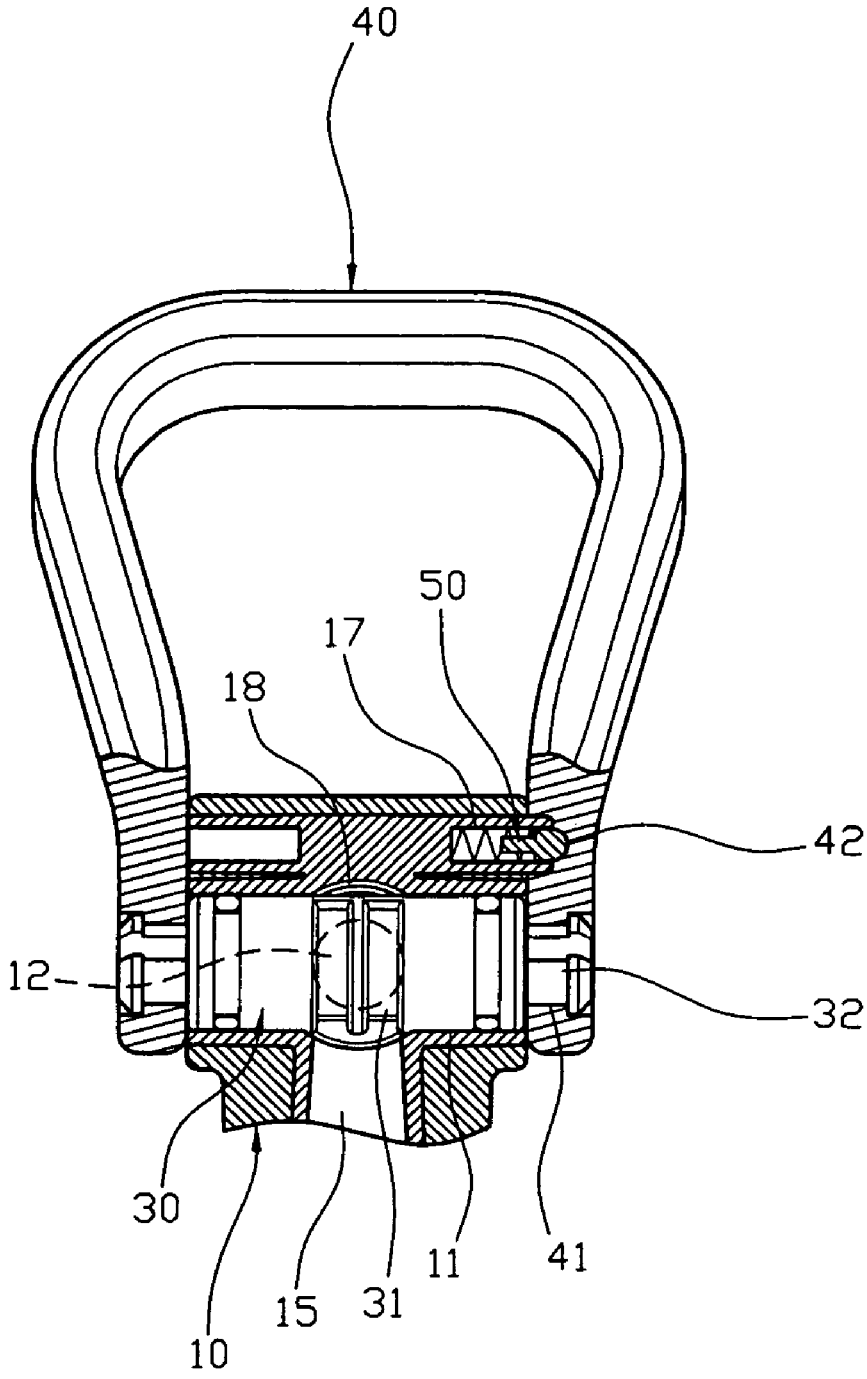
FIG. 4 is a partially plan cross-sectional view of the water sprayer as shown in FIG. 1.

When the control shaft 30 is rotatable to the position as shown in FIGS. 3 and 4, the stop wall 34 of the control shaft 30 isolates the water conduit 12 of the mounting seat 19 of the handle 10 to interrupt the connection between the water inlet channel 15 and the water conduit 12 so as to stop the water from the water inlet channel 15 of the handle 10.

Figure 5:
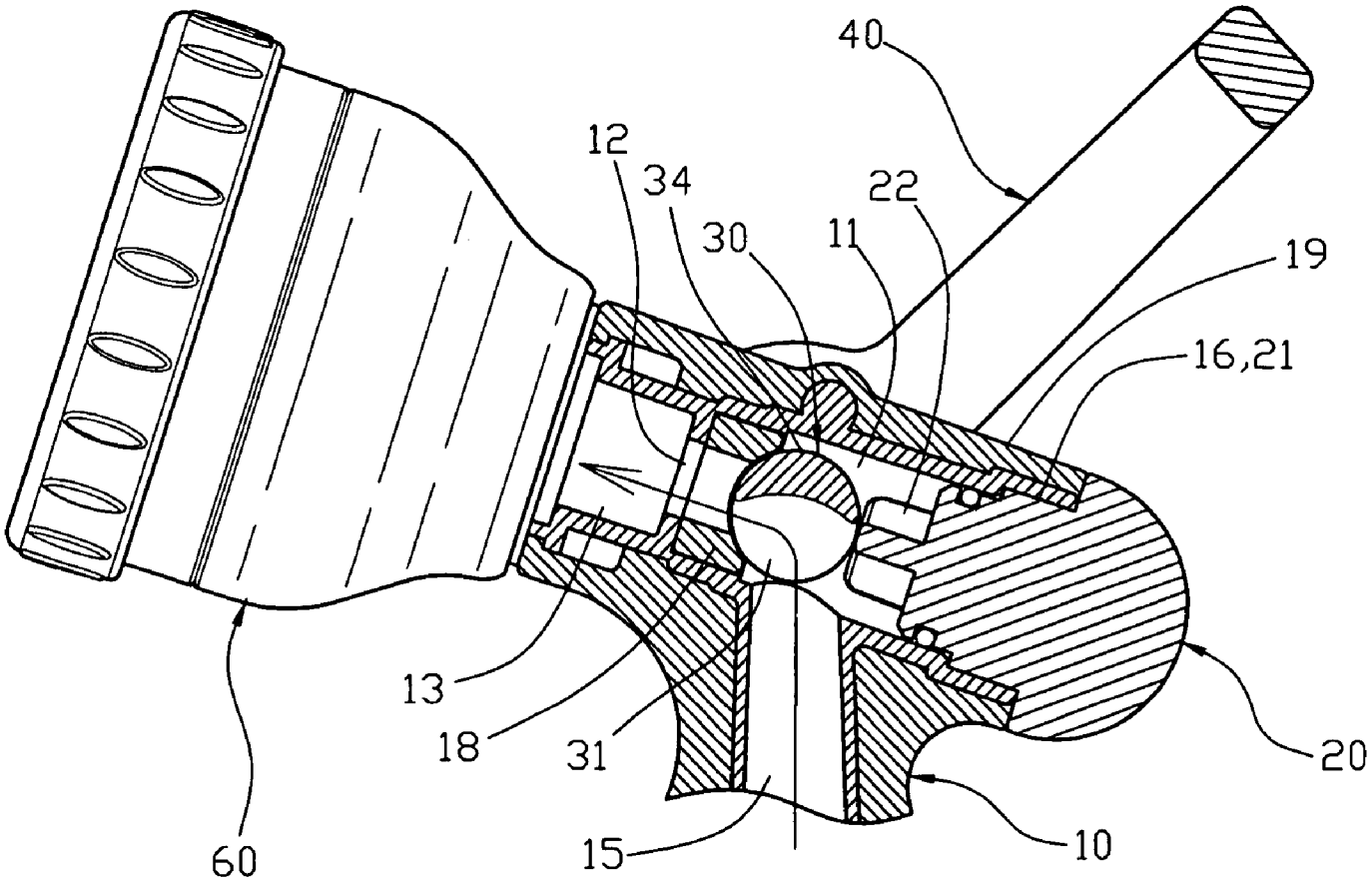
FIG. 5 is a schematic operational view of the water sprayer as shown in FIG. 3.
Figure 6:
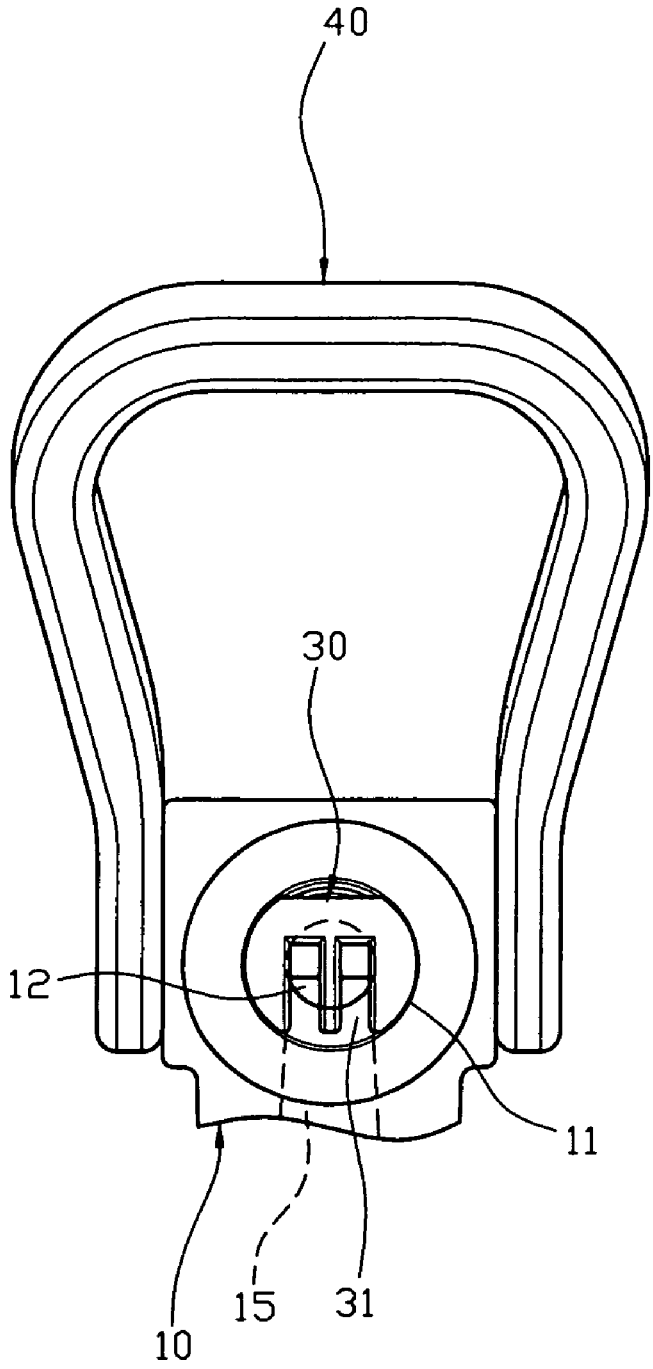
FIG. 6 is a schematic operational view of the water sprayer as shown in FIG. 4.

When the control shaft 30 is rotatable to the position as shown in FIGS. 5 and 6, the connecting slot 31 of the control shaft 30 is partially connected to the water conduit 12 of the mounting seat 19 of the handle 10 to open the connection between the water inlet channel 15 and the water conduit 12, so that the water from the water inlet channel 15 of the handle 10 flows through the connecting slot 31 of the control shaft 30, the water conduit 12 and the water outlet chamber 13 of the mounting seat 19 of the handle 10 into the spraying head 60 and is injected outwardly from the spraying head 60.

Figure 7:
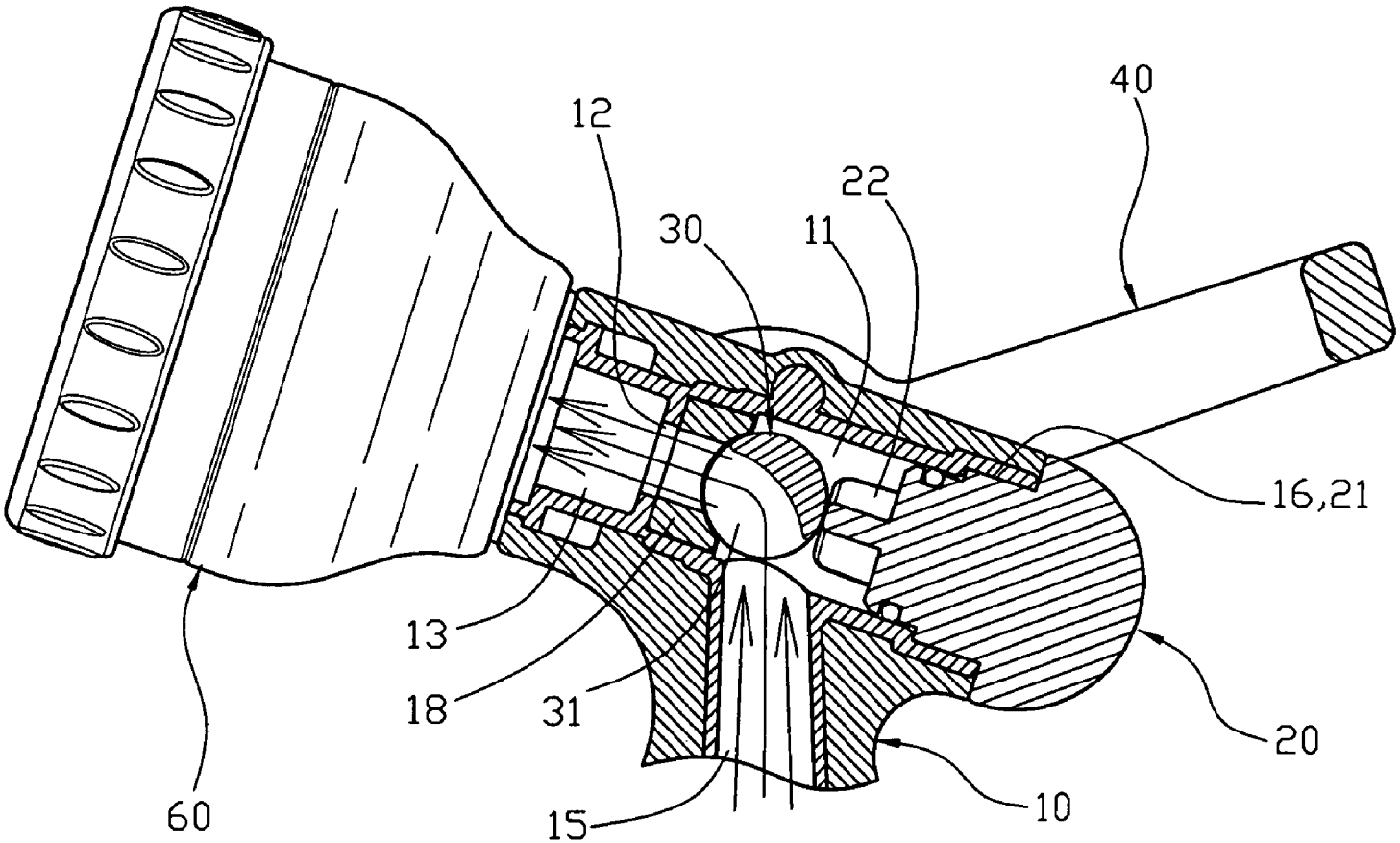
FIG. 7 is a schematic operational view of the water sprayer as shown in FIG. 5.
Figure 8:
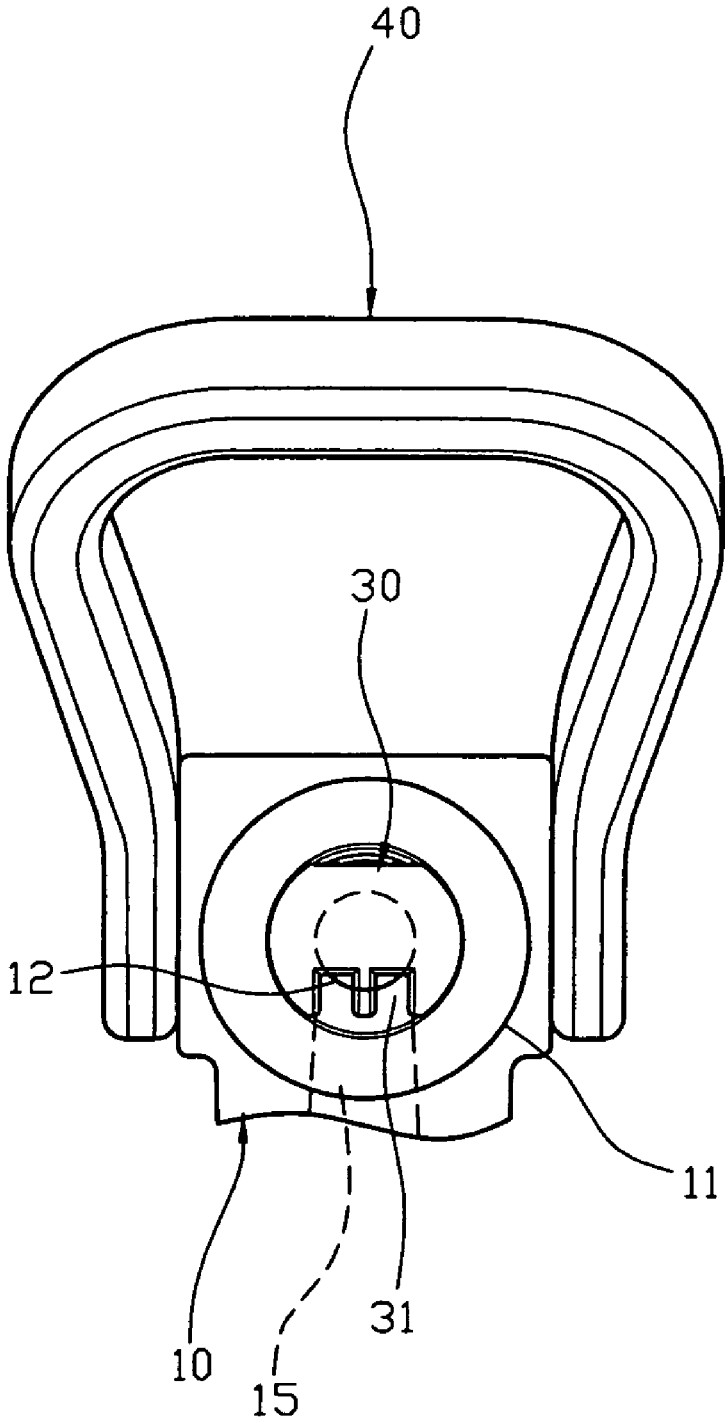
FIG. 8 is a schematic operational view of the water sprayer as shown in FIG. 6.

When the control shaft 30 is rotatable to the position as shown in FIGS. 7 and 8, the connecting slot 31 of the control shaft 30 is fully connected to the water conduit 12 of the mounting seat 19 of the handle 10, so that the flow rate reaches the maximum value.

Thus, the control shaft 30 is rotatable to regulate the water flow rate injected from the spraying head 60. In addition, the control handle 40 is positioned temporarily by the positioning member 50 so that the control shaft 30 is driven by the control handle 40 to rotate step by step to regulate the water flow rate in a micro-adjustment manner.

Figure 9:
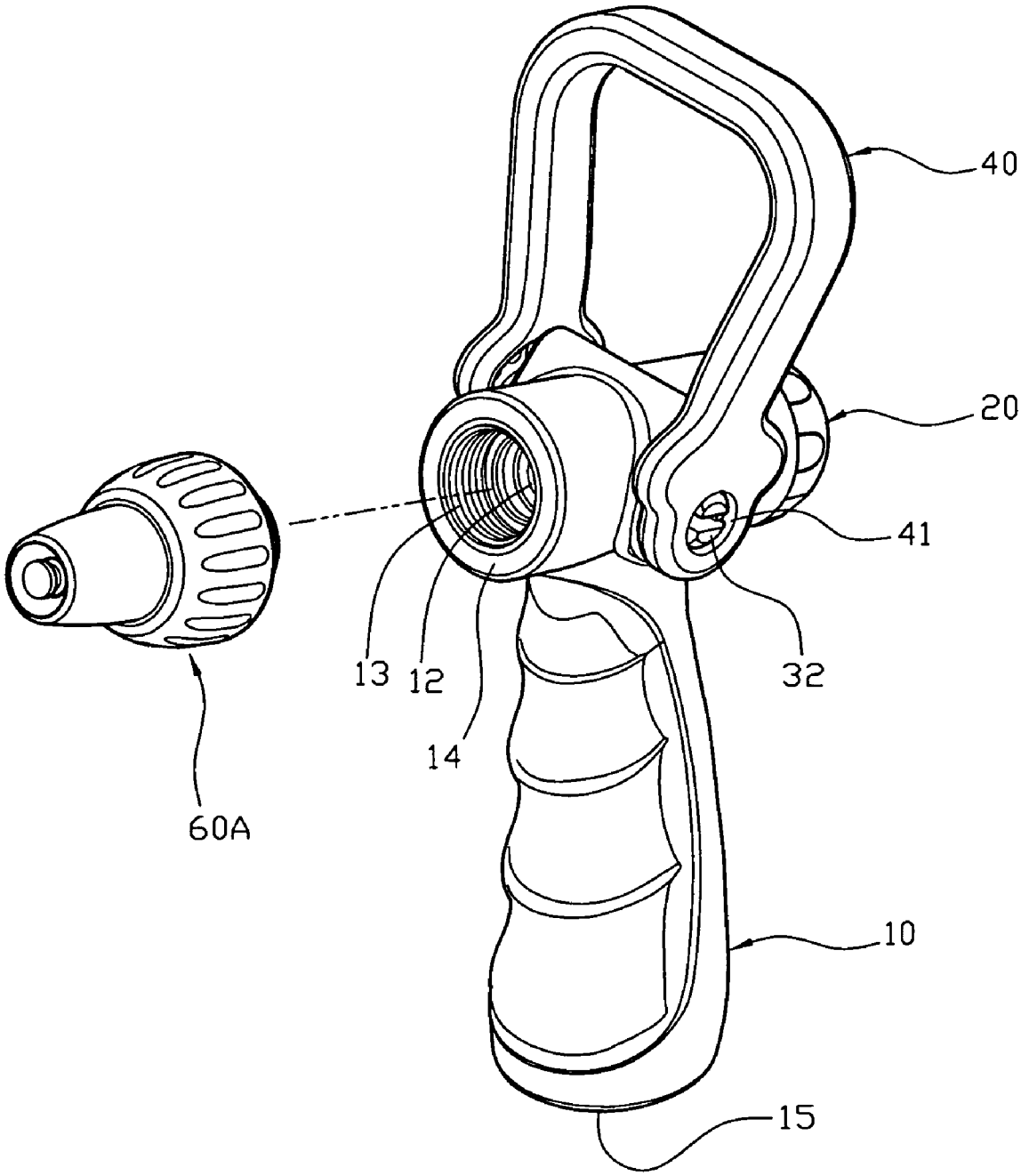
FIG. 9 is a partially exploded perspective view of a water sprayer in accordance with another preferred embodiment of the present invention.

As shown in FIG. 9, the spraying head 60A has a different shape.

Accordingly, the control shaft 30 is rotatable to regulate the water flow rate injected from the spraying head 60, so that the water sprayer has a flow regulating function. In addition, the control handle 40 is positioned temporarily by the positioning member 50 so that the control shaft 30 is driven by the control handle 40 to rotate step by step so as to regulate the water flow rate in a micro-adjustment manner. Further, the control handle 40 is positioned by the positioning member 50 to position the control shaft 30, so that the water sprayer has a constant water flow rate after adjustment of the control shaft 30. Further, the control handle 40 is positioned by the positioning member 50 so that the control shaft 30 is positioned after adjustment of the water flow rate, and the user needs not to hold the control handle 40 to keep the water flow rate at a constant value, thereby facilitating the user operating the water sprayer.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A water sprayer, comprising:

a handle having an inside formed with a water inlet channel and an end portion formed with a mounting seat which has a first end formed with a water conduit and a mediate portion formed with a receiving chamber connected to the water inlet channel and the water conduit;

a control shaft rotatably mounted in the receiving chamber of the mounting seat of the handle and having a first side formed with a stop wall and a second side formed with a connecting slot;

a control handle pivotally mounted on the mounting seat of the handle and connected to the control shaft to control rotation of the control shaft;

wherein the control shaft has two ends each provided with a flexible locking portion protruding from the receiving chamber of the mounting seat of the handle, and the control handle has two opposite sides each formed with a locking hole snapped and locked onto the respective locking portion of the control shaft to attach the control handle onto the control shaft.

2. The water sprayer in accordance with claim 1, wherein the control shaft is driven by the control handle and is rotatable between a first position where the connecting slot of the control shaft aligns with the water inlet channel of the handle and the water conduit of the mounting seat of the handle to open a connection between the water inlet channel and the water conduit, and a second position where the stop wall of the control shaft aligns with and isolates the water conduit of the mounting seat of the handle to interrupt the connection between the water inlet channel and the water conduit.

3. The water sprayer in accordance with claim 1, wherein the control handle has a plurality of positioning holes formed in at least one of the two opposite sides thereof and located above the locking hole, and the mediate portion of the mounting seat of the handle has a peripheral wall formed with at least one receiving recess located above the receiving chamber to receive a spring-biased positioning member which is detachably positioned in one of the positioning holes of the control handle to temporarily position the control handle on the mounting seat of the handle.

4. The water sprayer in accordance with claim 1, further comprising a spraying head mounted on the mounting seat of the handle and connected to the water conduit of the mounting seat of the handle.

5. The water sprayer in accordance with claim 4, wherein the first end of the mounting seat of the handle has a water outlet chamber connected between the water conduit and the spraying head.

6. The water sprayer in accordance with claim 1, wherein the first end of the mounting seat of the handle has an end face formed with a connector, and the spraying head has a distal end formed with a connecting portion connected with the connector of the mounting seat of the handle.

7. The water sprayer in accordance with claim 1, wherein the mounting seat of the handle has a second end formed with an opening connected to the receiving chamber.

8. The water sprayer in accordance with claim 7, further comprising an end cap mounted on the opening of the mounting seat of the handle and rested on the control shaft.

9. A water sprayer, comprising:

a handle having an inside formed with a water inlet channel and an end portion formed with a mounting seat which has a first end formed with a water conduit and a mediate portion formed with a receiving chamber connected to the water inlet channel and the water conduit;

a control shaft rotatably mounted in the receiving chamber of the mounting seat of the handle and having a first side formed with a stop wall and a second side formed with a connecting slot;

a control handle pivotally mounted on the mounting seat of the handle and connected to the control shaft to control rotation of the control shaft;

wherein the mounting seat of the handle has a second end formed with an opening connected to the receiving chamber;

an end cap mounted on the opening of the mounting seat of the handle and rested on the control shaft;

wherein the end cap has a distal end formed with a protruding push portion rested on the control shaft to push the control shaft toward the water conduit of the mounting seat of the handle so that the water conduit of the mounting seat of the handle is sealed closely by the stop wall of the control shaft.

10. A water sprayer, comprising:

a handle having an inside formed with a water inlet channel and an end portion formed with a mounting seat which has a first end formed with a water conduit and a mediate portion formed with a receiving chamber connected to the water inlet channel and the water conduit;

a control shaft rotatable mounted in the receiving chamber of the mounting seat of the handle and having a first side formed with a stop wall and a second side formed with a connecting slot;

a control handle pivotally mounted on the mounting seat of the handle and connected to the control shaft to control rotation of the control shaft;

wherein the mounting seat of the handle has a second end formed with an opening connected to the receiving chamber;

an end cap mounted on the opening of the mounting seat of the handle and rested on the control shaft;

wherein the end cap has a peripheral wall formed with a locking portion inserted into and locked in the opening of the mounting seat of the handle.

11. The water sprayer in accordance with claim 1, further comprising a gasket mounted in the mounting seat of the handle and located between the receiving chamber and the water conduit of the mounting seat of the handle.

12. The water sprayer in accordance with claim 11, wherein the gasket is pressed between the control shaft and an inner wall of the mounting seat of the handle.

13. The water sprayer in accordance with claim 1, wherein the control shaft has a cylindrical shape.

14. The water sprayer in accordance with claim 1, wherein the receiving chamber of the mounting seat of the handle traverses an axial direction of the mounting seat of the handle.

15. The water sprayer in accordance with claim 1, wherein the control handle is substantially inverted U-shaped.

16. The water sprayer in accordance with claim 3, wherein the positioning holes of the control handle surround the locking hole and are arranged in an arc-shaped manner.

17. The water sprayer in accordance with claim 1, wherein the connecting slot of the control shaft is located at a middle portion of the control shaft.

* * * * *